US008292195B2

(12) United States Patent
Freeman

(10) Patent No.: US 8,292,195 B2
(45) Date of Patent: Oct. 23, 2012

(54) WATER PANEL

(76) Inventor: Patrick Freeman, Tulsa, OK (US)

( * ) Notice: Subject to any disclaimer, the term of this patent is extended or adjusted under 35 U.S.C. 154(b) by 719 days.

(21) Appl. No.: 12/490,963

(22) Filed: Jun. 24, 2009

(65) Prior Publication Data

US 2010/0327076 A1 Dec. 30, 2010

(51) Int. Cl.
*F21S 8/00* (2006.01)

(52) U.S. Cl. ..... 239/20; 239/17; 239/18; 239/23; 362/96; 362/101

(58) Field of Classification Search ..... 239/17, 239/18, 20, 23; 119/253; 362/96, 101
See application file for complete search history.

(56) References Cited

U.S. PATENT DOCUMENTS 3,008,646 A * 11/1961 Benak ..... 239/20
3,211,378 A * 10/1965 Zysk ..... 239/20
5,167,368 A 12/1992 Nash
5,226,935 A 7/1993 Wolff et al.
6,149,070 A * 11/2000 Hones ..... 239/17
6,152,381 A 11/2000 Hones
6,206,298 B1 * 3/2001 Ting ..... 239/20
6,279,835 B1 8/2001 Hansen
6,416,197 B1 7/2002 Chang

* cited by examiner

*Primary Examiner* — Jason Boeckmann
*Assistant Examiner* — Joel Zhou
(74) *Attorney, Agent, or Firm* — Molly D. McKay

(57) ABSTRACT

A frameless portable water panel for displaying advertising and products constructed of transparent material combining a water wall column and cascading water tanks supporting dry, removable display shelves. Water is pumped into a tall water column from a bottom reservoir with a water pump. Water fills the tall water column and flows down on the outside of the front wall of the column then into a series of cascading water tanks before returning to the bottom reservoir. An alternate embodiment is modified to serve as a self-serve drinking fountain by removing the lowest shelf and adding fountain openings in the outside face of the front wall of one of the cascading tanks. Other modifications including bevel top edges on the water column, a light pan under the unit, pegs to secure the shelves, clear splash guards on the back of all shelves, and supporting legs under each shelf.

9 Claims, 5 Drawing Sheets

WATER PANEL

CROSS-REFERENCE TO RELATED APPLICATIONS

This application claims priority from U.S. patent application Ser. No. 11/638,268 filed on Dec. 13, 2006 under the title Water Panel which in turn claims priority from U.S. Provisional Patent Application No. US60/597,762 filed on Dec. 19, 2005 under the title of Water Panel Usable as Functional Waterfall without Need for Tubes/Hoses/Top Reservoir.

BACKGROUND OF THE INVENTION

1. Field of the Invention

The present invention relates to a portable, customizable water panel combining a water wall, waterfalls and product display shelves into a unit for displaying advertising and products that is an impressive, visually pleasing display that produces a soothing sound.

2. Description of the Related Art

Waterfalls provide good visual interest and produce a pleasing and calming sound that is relaxing to people who are around them. Waterfalls and water features can create pleasing ambiance and also serve to increase the humidity in the air surrounding them, particularly when they are located within a building.

However, most waterfalls are either built as a permanent feature or are so heavy that they are not very portable to remote locations where special events are to be held. Also, most other waterfalls use hoses to move water to a top spilling reservoir or dam, and both the hoses and top reservoir must be framed in to hide them from view. Also, the water splashes out of most waterfalls or water features and tends to get the surrounding objects and surfaces wet. Thus, it is generally not desirable to place papers or other water intolerant objects near most waterfalls and water features. Water splashed out onto a floor from a waterfall or water feature can make the floor slippery and dangerous for those who might walk on the wet floor. Another disadvantage with most waterfalls and water features is that they can only be viewed from one side since the waterfall or water feature itself is not transparent. A further limitation of most waterfalls or water features is that they do not provide shelves in association therewith for displaying objects or products. Further, most waterfalls or water features are not designed to display advertising, company insignias, backlit advertising transparencies, trademarks or service marks, messages, etc.

The present invention addresses the problems associated with current waterfalls and water features by providing a light weight, portable water panel that has product display shelves for holding products or objects. The present invention allows water to cascade down the face of transparent walls to create the visual effect of a waterfall without having water splashing out of the unit. Because the water flows down the face of the walls of the present invention, it does not get surrounding objects and surfaces wet. Paper and other water intolerant objects can be safely placed on the dry shelves provided on this invention. The present invention is constructed of transparent material so that it can be viewed from a full 360 degree area surrounding the invention. This allows the invention to be used in the middle of a room as the focal point for an event or party. The present invention is provided with a tall water column constructed with front and back column walls that are designed to display all types of advertising, company insignias, trademarks or service marks, messages, etc. When displayed on the present invention, the advertising is viewed through the clear walls of the unit and through a wall of water flowing over the walls. This results in a slight blurring of the image which adds to the visual impact provided by the unit. Further, the unit can be equipped with internal or external lighting, and with a remote control for remote activation of the unit's water pump and lights.

The water panel of the present invention can be used in a variety of ways and for a variety of purposes. Some, but not all, of the uses for the invention include use as a liquor bottle display rack for upscale night clubs, casinos, and restaurants; lobby signage device for hotels, hospitals and office buildings; advertising billboard for use in airports; beauty products display for salons; retail store display; waiting room water fountains for offices of professionals such as accountants, lawyers, doctors, etc.; "faith fountains" for churches and charities for receiving coin donations; display for collectibles in upscale homes; or almost anywhere as an aquarium or display shelf either including or not including advertising.

An alternate embodiment of the invention is modified to serve as a self-serve drinking fountain by removing the lowest shelf and adding fountain openings in the outside face of the front wall of one of the cascading tanks as a place at which drinking glasses can be filled. Other modifications including adding a bevel top edges on the water column, a light tray under the water column, pegs to secure the shelves, a splash guard on the upper shelf, and supporting legs under the shelves.

SUMMARY OF THE INVENTION

The present invention is a portable, customizable water panel combining a water wall, waterfalls and dry product display shelves into a unit for displaying advertising and products that is impressive and visually pleasing and that produces a soothing sound.

The water panel is constructed of transparent sheet material such as acrylic that is secured together with glue, bolts, or other suitable means. The water panel is provided with one tall water column. The tall water column is provided with a front wall, a rear wall and two column side walls that form a column sealed to a base sheet on its bottom end and open at its top end so that the tall water column can hold water. Like a mailing envelope, the two panels, i.e. the front and real walls, are sealed on their sides and bottom. The front and rear walls of the tall water column are preferably held in parallel, spaced apart orientation by a combination of clear plastic discs glued between the walls to maintain a space between the walls and by rust proof stainless steel or chrome bolts and nuts that secure through the walls to prevent the walls from being pushed apart or bowed by the force of water contained between the walls when the water panel is in use. These bolts preferably will pass through bolt spacers provided between the walls and will have rubber washers to seal around the bolts and bolt openings provided in the walls. The locations and numbers of plastic discs and bolts employed will be dictated by the size and shape of the water panel that is to be produced.

The tall water column extends above several cascading water tanks and above a base or bottom reservoir so that advertising can be attached to the tall water column and be visible above the cascading water tanks and bottom reservoir. Advertising can be attached to either the outside face of the front wall of the tall water column or to the outside face of the rear wall of the tall water column. Because the tall water column is constructed of transparent material, the advertising can be seen through the front and rear walls of the tall water column and through the water that will be contained within and overflowing from the tall water column.

The bottom reservoir is initially filled with water so that the water does not overflow the bottom reservoir. Then, water from the bottom reservoir is pumped into the tall water column via a water pump that is located in the bottom reservoir. Unlike most other waterfalls, the unit does not use hidden hoses to fill itself. As the water from the bottom reservoir is pumped into the transparent water column, a striking and unusual effect is created as a visible line of water fills up the water column, finally overflowing naturally over the top of the water column at the shortest wall or walls of the column and then down the face of faces of the column's shortest wall or walls. The water pump's electrical cord extends through one or more cord openings provided in the water panel so that the cord is as inconspicuous as possible. Preferably the electrical cord extends through either the side of the water panel, as shown in the drawings, or through the back of the water panel by passing through both the front and rear walls of the tall water column. The pump's electrical cord extends out of the water panel and receives electrical power from the building's electrical power supply, not illustrated.

A discharge end of the water pump is secured to a threaded opening formed in the front wall of the tall water column. The front wall of the tall water column is a common wall separating the tall water column and the bottom reservoir and serves as the back wall of the bottom reservoir. The water pump pulls water from the bottom reservoir and pumps it into the bottom of the tall water column. Unlike most waterfalls, no hidden top filling reservoir or holding dam is used to create water spill. Instead, as the water is pumped into the transparent chamber formed inside the tall water column, a visible rising water line reaches the open top end of the column where the water begins to naturally overflow on the outside face or faces of the tall water column's shortest wall or walls. Normally, the shortest wall is the front wall of the tall water column and the column side walls and the rear wall are slightly taller than the front wall.

However, although not illustrated, it is possible to have both the front and rear walls of the tall water column at the same height and have the column side walls of a taller height so that water flows on the outside faces of both the front and rear walls of the tall water column into cascading tanks located on both the front and rear sides of the tall water column. In this alternate embodiment, the tall water column is provided with two sets of cascading water tanks, with one set of tanks located at the front of the tall water column and the second set of tanks located at the rear of the tall water column. This alternate embodiment would have a separate bottom reservoir and a separate water pump associated with each of two sets of tanks.

Referring back to the embodiment of the invention that is illustrated and has only one set of cascading water tanks, the water overflowing out of the top end of the tall water column flows down the outside face of the front wall of the tall water column in a transparent sheet of water and into a first cascading tank located adjacent to the outside face of the front wall of the tall water column. Each of the cascading tanks is provided with a bottom that is elevated above the underlying bottom reservoir and is supported by parallel stair stepped side walls. The stair stepped side walls are provided adjacent to and on either side of the front panel of the tall water column and are secured at their bottom edges to the base sheet that forms the bottom of the bottom reservoir and the bottom of the tall water column. The stair stepped side walls form the side walls for the cascading tanks and the side walls for the underlying bottom reservoir.

Each of the cascading tanks is provided with a front wall that is secured to both of the stair stepped side walls and to the tank's bottom so that the cascading tank holds water and is open on its top end. The front wall of the first cascading tank is a common wall between the first and second cascading tanks and also serves as the back wall for the second cascading tank. The front wall of each tank is vertically oriented and is located slightly behind a vertical front edge of the wall's associated stair step and slightly below a horizontal upper edge of the wall's associated stair step so that as water overflows each of the cascading tanks, the water flows down the outside face of the front wall of the cascading tank and is retained within the water panel.

The first cascading tank is filled until it overflows out of its top end. The water from the first cascading tank flows down on an outside face of its front wall in a sheet to a second cascading tank located adjacent to the front wall of the first tank on its lower end. The second cascading tank is filled until it also overflows out of its top end. The water from the second cascading tank flows down on an outside face of the front wall of the second cascading tank in a sheet until the water finally freefalls as an airborne water curtain into the bottom reservoir located under the front wall of the second cascading tank. A front wall of the bottom reservoir is provided in front of the second cascading tank and is secured to the base sheet and to the stair stepped side walls. The bottom reservoir extends forward of the front wall of the second cascading tank and extends rearward under the cascading tanks to the front wall of the tall water column that serves as both the rear wall of the bottom reservoir and the rear wall of the first cascading tank. The bottom reservoir holds water and is open at its top end.

Removable display shelves can be placed above each of the cascading tanks and above the front end of the bottom reservoir so that the display shelves remain dry. Each shelf extends between the two stair stepped side walls with opposite ends of each shelf resting on the horizontal upper edges of the wall's associated stair steps. Cleats are provided on the bottom of each shelf to prevent the shelves from slipping off of the stair stepped side walls. Shelf spacers are provided on either end of and behind the display shelf associated with the first cascading tank to space the shelf away from the front wall of the tall water column thereby allowing the water that is flowing from the tall water column to pass between the front wall of the tall water column and the shelf and enter into the first cascading tank.

Separate light pans or light bases can be set underneath the transparent unit or light fixtures can optionally be provided in the bottom reservoir for up lighting the water panel and its associated shelves. Any type of lighting fixture may be employed, including, but not limited to, halogen, LED, florescent, incandescent, etc. Although not illustrated, lighting fixtures can alternately or additionally be placed underneath, above, behind, or in front of the water panel to achieve the desired lighting effects.

Also, the water can be tinted with food coloring agents to make the water the desired color. Blue is the most popular color for the water. Further ornamentation can be provided by placing various objects in the cascading tanks or the bottom reservoir. Such objects might include either live or imitation fish, real or plastic ice cubes, real or imitation fruit slices, or other suitable ornaments.

An alternate embodiment of the present invention is modified to serve as a self-serve drinking fountain. This alternate embodiment removes the lowest removable display shelf and adds fountain openings in the outside face of the front wall of the second cascading tank so that liquid, such as alcoholic beverages, contained within the alternate embodiment water panel can flow through each of the fountain openings in a separate stream that can be captured in a drinking glass by placing the glass under the flowing stream. When drinking glasses are not located under the flowing streams, the stream of beverage falls into the bottom reservoir and is recycled through the water panel. This alternate embodiment may also include several other modifications.

One modification is to include a 45 degree bevel on the top ends of the tall water column so as to better receive and reflect light. This bevel is provided on the top edges of back, front and both side panels of the tall water column.

Still another modification is the addition of a light tray under the water column so that light is directed up into the water column and is made visible by the 45 degree beveled top ends of the tall water column. The light tray is a separate accessory and preferable is placed under the water column as a base upon which the water column rests. The light tray is provided with a electric power cord for attachment to an electrical power supply and is preferably provided with a plurality of LED lights that are directed upward. The light tray is separate from the water column and therefore is not in contact with the liquid contained in the water column. The light tray adds to the visual effect of the water column, particularly when used in a setting where the ambient light is low. The light tray may be constructed of clear materials so that the light from the LED lights is free to travel upward through the light tray and through the water column.

Another modification is the addition of downwardly extending pegs provided on the bottom of each shelf at the ends of the shelves. These pegs are received into peg openings provided in the stair stepped side walls to positively retain the shelves on the side walls and thereby prevent the shelves from slipping off of the stair stepped side walls. The pegs and peg holes are located so that the highest shelf is spaced away from the front wall of the tall water column so water can pass behind the highest shelf. Also the pegs and peg holes are located so that the other shelf is located away from the outside face of the front wall of the cascading tank located behind or upstream in the flow path from the shelf so that water that flows down the front wall of the water chambers can pass behind the shelf without contacting and getting water on the shelf located in front of the water chamber. Addition of these pegs to the shelves makes it unnecessary to include shelf spacers and cleats on the shelves.

Still another modification is the addition of an upwardly extending splash guard back wall attached to the upper shelf. This splash guard back wall is preferably provided with a forward extending wire bend top lip that extends forward at approximately a 45 degree angle from the vertical back wall. The purpose of the splash guard back wall and the wire bend top lip is to prevent water from being splashed up onto the back shelf from the water that is falling down the front face of the tall water column. Thus, this alternate embodiment is designed to maintain the shelves in a dry condition, which is important when the shelves of the water panel are being employed to display items that might be adversely affected by contact with moisture or may slip or become slippery when placed on a wet shelf.

Finally, the shelves of the alternate embodiment may be provided with legs under the shelves that extend downward from the bottom of the shelves and rest on the bottom of the cascading tanks located under the shelves. The addition of these legs provide additional support to the shelves to prevent them from bowing or breaking and is particularly important if the shelves are long or the items that are to be displayed on the shelves are heavy.

DETAILED DESCRIPTION OF THE PREFERRED EMBODIMENT

Figure 1:
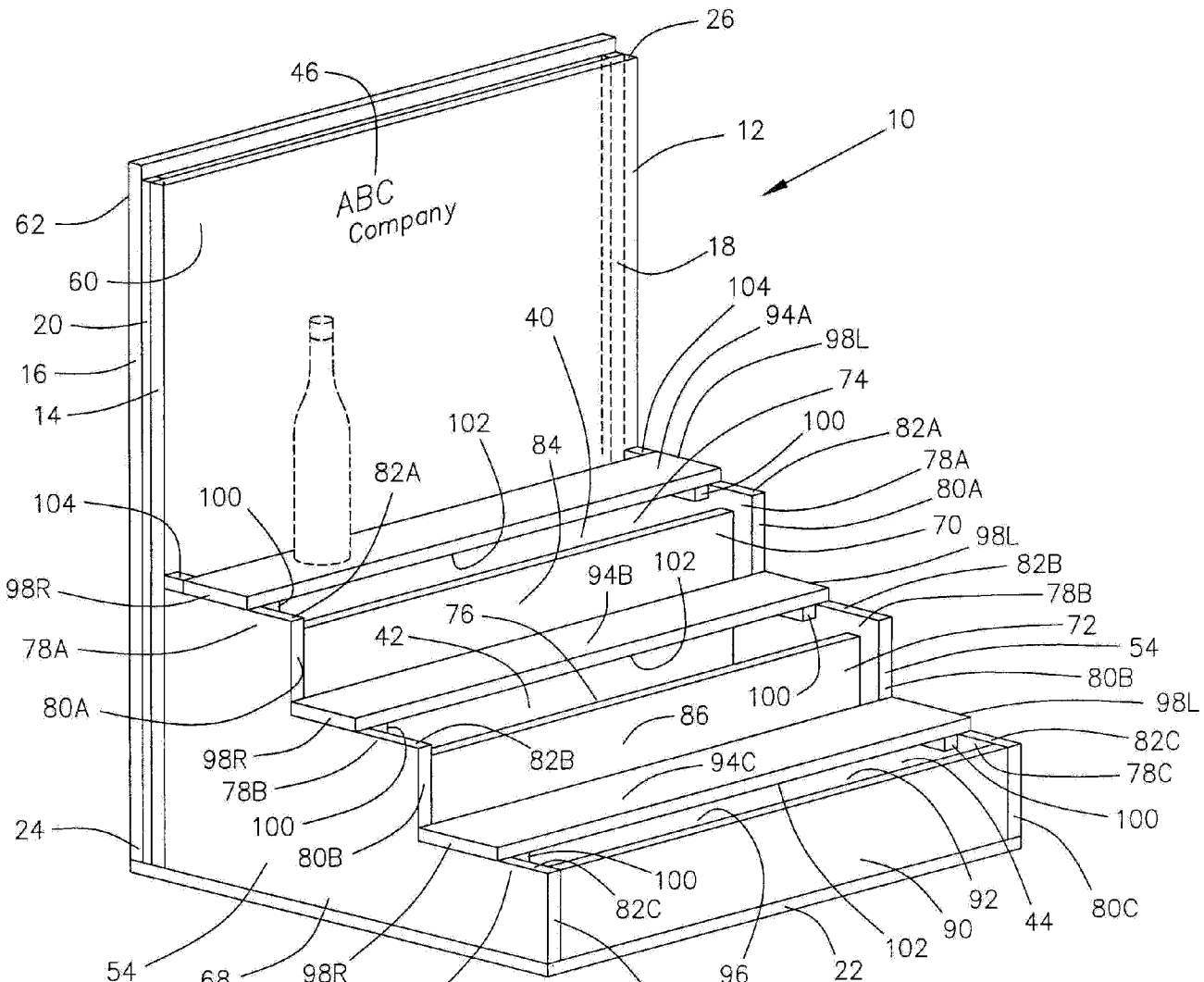
FIG. 1 is a perspective view of a water column constructed in accordance with a preferred embodiment of the present invention.

Referring now to the drawings and initially to FIG. 1, there is illustrated a portable, customizable water panel 10 constructed in accordance with a preferred embodiment of the present invention. The water panel 10 combines a water wall, waterfalls and product display shelves into a unit for displaying advertising and products that is visually pleasing and impressive and that produces a soothing sound.

Figure 3:
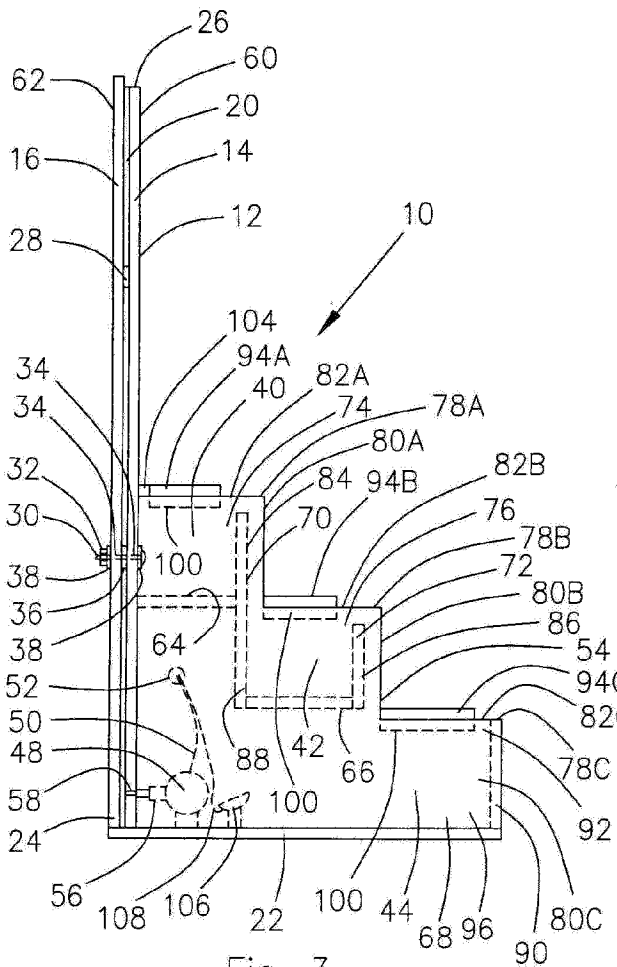
FIG. 3 is a side view taken along line 3-3 of FIG. 2.

Referring to FIGS. 1 and 3, the water panel 10 is constructed of transparent sheet material such as acrylic that is secured together with glue, spacers, bolts, or other suitable means, as will be more fully described hereafter. Because the water panel 10 is constructed of transparent material, the water can be seen from all sides of the water panel 10. The water panel 10 is provided with one tall water column 12. The tall water column 12 is provided with a front wall 14, a rear wall 16 and two column side walls 18 and 20 that form a column 12 sealed to a base sheet 22 on its bottom end 24 and open at its top end 26 so that the tall water column 12 can hold water. The two column side walls 18 and 20 are internal clear spacer strips or ribs that are very thin—only an eighth of the thickness of the actual front and back water column walls 14 and 16. The column side walls 18 and 20 do not protrude outward. Since it is desirable that the column 12 not appear as a tank, it's side walls 18 and 20 are nothing more than 1" wide spacer strips with glue on both sides to hold the front and rear walls 14 and 16 together at the sides and at the bottom in a manner similar to a mailing envelope that is held together on three sides and is open at the top.

Figure 2:
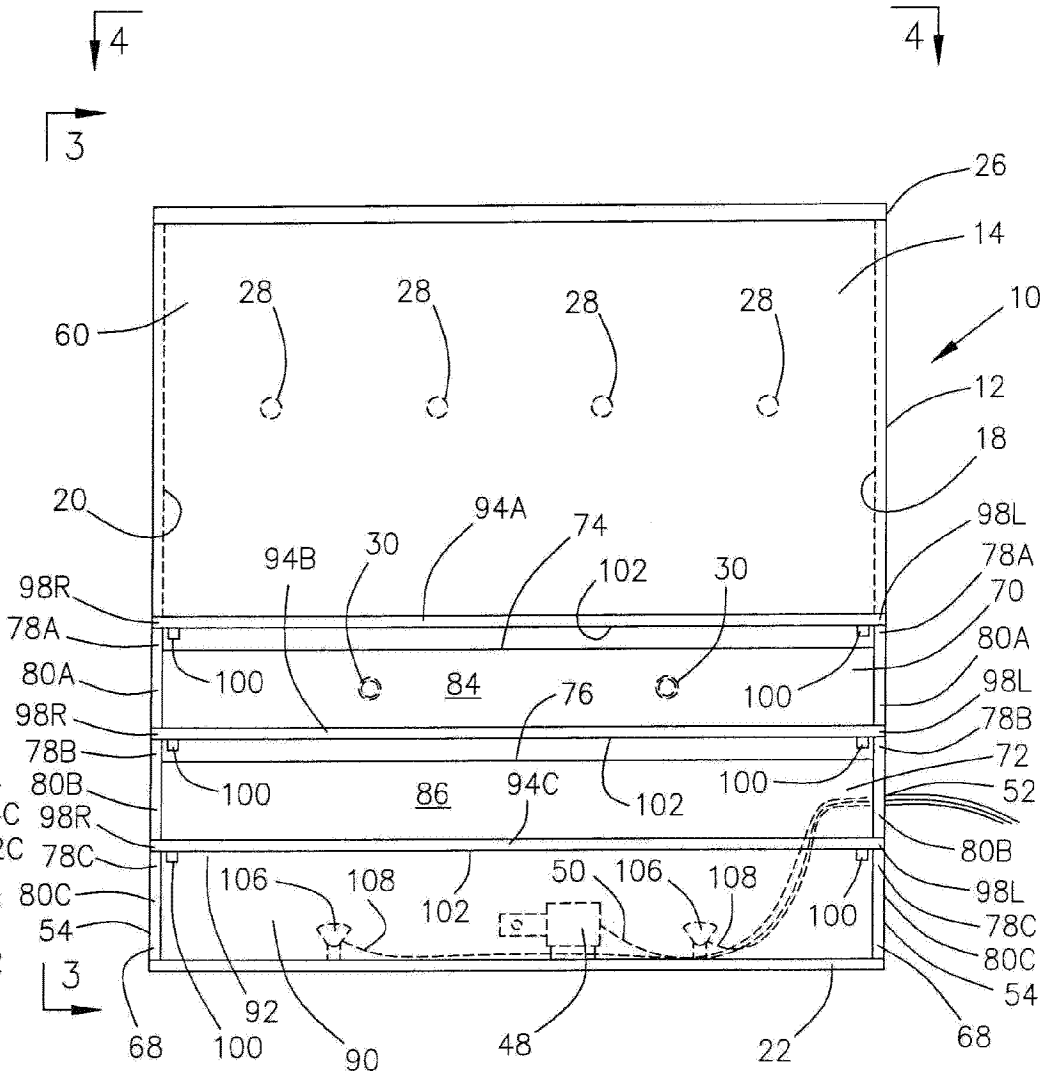
FIG. 2 is a front view of the water column of FIG. 1.
Figure 4:
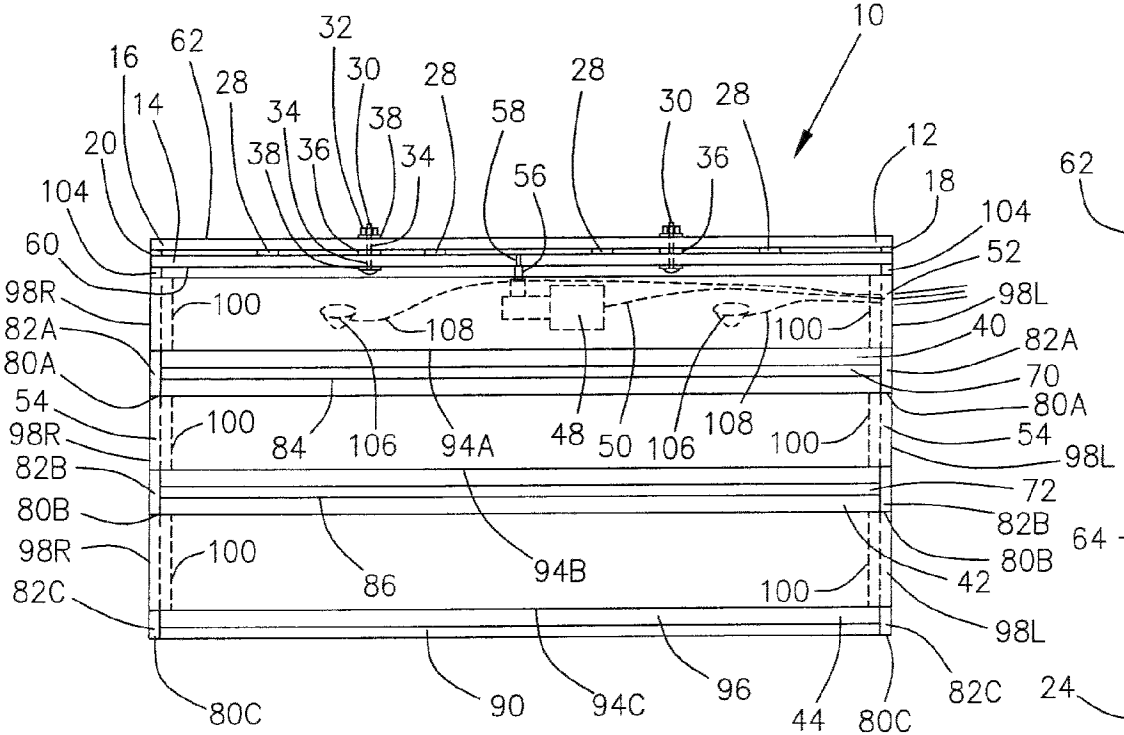
FIG. 4 is a top plan view taken along line 4-4 of FIG. 2.

Referring to FIGS. 2, 3 and 4, the front and rear walls 14 and 16 of the tall water column 12 are preferably held in parallel, spaced apart orientation by a combination of clear plastic discs or spacers 28 glued between the walls to maintain a space between the front and rear walls 14 and 16 and by rust proof stainless steel or chrome bolts 30 and nuts 32 that secure through bolt openings 34 provided in the front and rear walls 14 and 16 to prevent the walls 14 and 16 from being pushed apart or bowed by the force of water contained between the walls 14 and 16 when the water panel 10 is in use. These bolts 30 preferably will pass through bolt spacers 36 provided between the walls 14 and 16 and will have rubber washers 38 to seal around the bolts 30 and bolt openings 34 provided in the front and rear walls 14 and 16. The locations and numbers of plastic discs 28 and bolts 30 employed will be dictated by the size and shape of the water panel 10 that is to be produced.

The tall water column 12 extends above several cascading water tanks 40 and 42 and above a base or bottom reservoir 44 so that advertising can be attached to the tall water column 12 and be visible above the cascading water tanks 40 and 42 and bottom reservoir 44. Although only two cascading water tanks 40 and 42 are illustrated, the invention is not so limited. Advertising, artwork or lettering 46 such as vinyl or backlit transparencies can be attached to either the outside face 60 of the front wall 14 of the tall water column 12 or to the outside face 62 of the rear wall 16 of the tall water column 12. Because the tall water column 12 is constructed of transparent material, the advertising 46 can be seen through the front and rear walls 14 and 16 of the tall water column 12 and through the water that will be contained within and overflowing from the tall water column 12. The water slightly blurs the advertising, artwork or lettering 46 in an esthetically pleasing manner.

Figure 5:
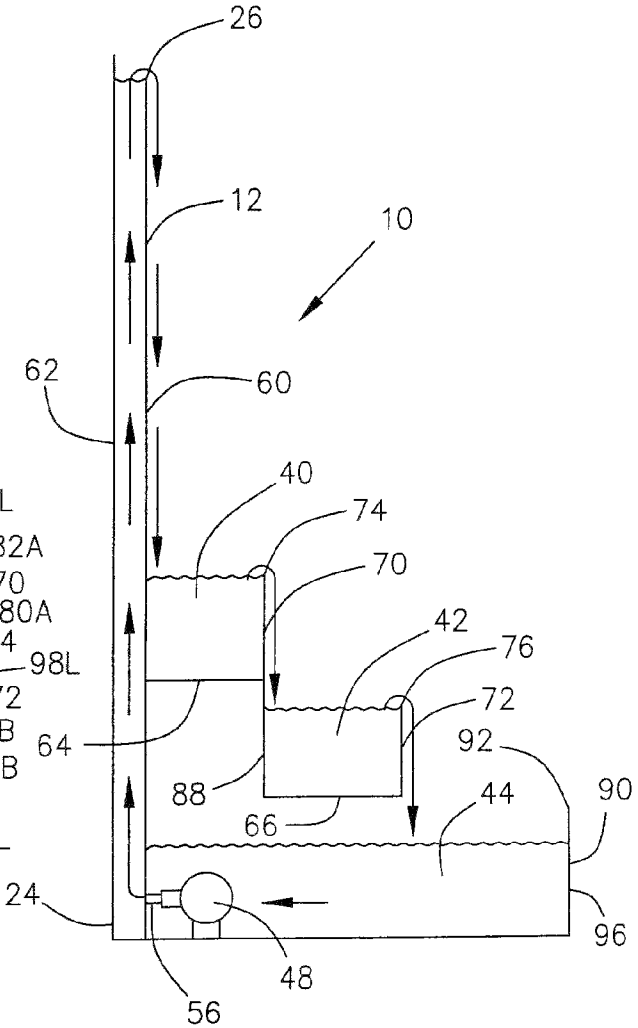
FIG. 5 is a diagram showing the flow of water through the water column of FIG. 3.

Referring also to FIG. 5, the bottom reservoir 44 is initially filled with water so that the water does not overflow the bottom reservoir 44. Then, water from the bottom reservoir 44 is pumped into the tall water column 12 via a water pump 48 that is located in the bottom reservoir 44. The water pump's electrical cord 50 extends through one or more cord openings 52 provided in the water panel 10 so that the cord 50 is as inconspicuous as possible. Preferably the electrical cord 50 extends through either the stair stepped side wall 54 of the water panel 10, as shown in FIGS. 2 and 3, or through the tall water column 12 of the water panel 10 by passing through both the front and rear walls 14 and 16 of the column 12. The pump's electrical cord 50 extends out of the water panel 10 and receives electrical power from the building's electrical power supply, not illustrated.

As shown in FIGS. 3, 4 and 5, a discharge end 56 of the water pump 48 is secured to a threaded opening 58 formed in the front wall 14 of the tall water column 12. The front wall 14 of the tall water column 12 is a common wall separating the tall water column 12 and the bottom reservoir 44 and serves as the back wall of the bottom reservoir 44. The water pump 48 pulls water from the bottom reservoir 44 and pumps it into the bottom end 24 of the tall water column 12, thereby filling the tall water column 12. As the water fills the transparent tall water column 12, a striking and unusual effect is created. A visible water line of water fills up the tall water column 12 until the water reaches the open top end 26 of the tall water column 12 and then the water will begin to overflow on the outside face of the shortest wall of the tall water column 12. Normally, the shortest wall is the front wall 14 of the tall water column 12 and the water overflows on the outside face 60 of the front wall 14. The column side walls 18 and 20 and the rear wall 16 are normally slightly taller than the front wall 14.

However, although not illustrated, it is possible to have an alternate embodiment where the tall water column 12 is provided with two sets of cascading water tanks: one set of tanks 40 and 42 located adjacent to the front wall 14 of the tall water column 12 and a second set of additional cascading tanks (not illustrated) located adjacent to the rear wall 16. In this alternate embodiment, both the front and rear walls 14 and 16 of the tall water column 12 are at the same height and are shorter than the column side walls 18 and 20 so that water flows out of the top end 26 of this alternate column and on the outside face 60 of the front wall 14 of the tall water column 12 into cascading tanks 40 and 42 located adjacent the front wall 14 and also flows on the outside face 62 of the rear wall 16 of the tall water column 12 into additional cascading tanks (not illustrated) located adjacent the rear wall 16. This alternate embodiment could also have a separate bottom reservoir (not illustrated) and a separate water pump (not illustrated) associated with the second set of tanks.

Referring back to the embodiment of the invention that is illustrated in the drawings and which has only one set of cascading water tanks 40 and 42, the water overflowing out of the top end 26 of the tall water column 12 flows down the outside face 60 of the front wall 14 of the tall water column 12 in a transparent sheet of water and into the first cascading tank 40 located adjacent to the front wall 14 the tall water column 12. Each of the cascading tanks 40 and 42 is provided with a bottom 64 and 66 that is elevated above the underlying bottom reservoir 44 and is supported by two parallel stair stepped side walls 54. The stair stepped side walls 54 are provided adjacent to and on either side of the front wall 14 of the tall water column 12 and are secured at their bottom edges 68 to the base sheet 22 that forms the bottom of the bottom reservoir 44 and the bottom of the tall water column 12. The stair stepped side walls 54 form the side walls for the cascading tanks 40 and 42 and the side walls for the underlying bottom reservoir 44.

As illustrated in FIGS. 1, 3 and 4, each of the cascading tanks 40 and 42 is provided with a front wall 70 and 72 respectively that is secured to both of the stair stepped side walls 54 and to the tank's bottom 64 and 66 so that the cascading tank 40 and 42 holds water and is open on its top end 74 and 76. The front wall 70 of the first cascading tank 40 is a common wall between the first and second cascading tanks 40 and 42 and also serves as the back wall for the second cascading tank 42.

Each of the cascading tanks 40 and 42 and the bottom reservoir 44 is associated with a stair step 78A, 78B and 78C provided on each of the stair stepped side walls 54. The front wall 70 and 72 of each cascading tank 40 and 42 is vertically oriented and is located slightly behind a vertical front edge 80A and 80B of its associated stair step 78A and 78B and slightly below a horizontal upper edge 82A and 82B of the wall's associated stair step 78A and 78B so that as water overflows each of the cascading tanks 40 and 42, the water flows down the outside face 84 and 86 of the front wall 70 and 72 of the cascading tank 40 and 42 and is retained within the water panel 10.

Referring now to FIGS. 1 and 5, the first cascading tank 40 is filled by the overflow from the tall water column 12 until the first cascading tank 40 overflows out of its top end 74. The water from the first cascading tank 40 flows down on the outside face 84 of its front wall 70 in a sheet of water to the second cascading tank 42 located adjacent to the front wall 70 of the first cascading tank 40 and on its lower end 88. The second cascading tank 42 is filled until it also overflows out of its top end 76. The water from the second cascading tank 42 flows down on the outside face 86 of the front wall 72 of the second cascading tank 42 in a sheet until the water finally freefalls as an airborne water curtain into the bottom reservoir 44 located under the front wall 72 of the second cascading tank 42. A front wall 90 of the bottom reservoir 44 is provided in front of the second cascading tank 42 and is secured to the base sheet 22 and to a vertical front edge 80C of the lowest stair step 78C provided on each of the stair stepped side walls 54. The bottom reservoir 44 extends forward of the front wall 72 of the second cascading tank 42 and extends rearward under the cascading tanks 40 and 42 to the front wall 14 of the tall water column 12 that serves as both the rear wall of the bottom reservoir 44 and the rear wall of the first cascading tank 40. The bottom reservoir 44 holds water and is open at its top end 92.

Removable display shelves 94A, 94B and 94C are illustrated in FIGS. 1, 2 and 3. The display shelves 94A, 94B and 94C are placed above each of the cascading tanks 40 and 42 and above a front end 96 of the bottom reservoir 44. Each shelf 94A, 94B and 94C extends between the two stair stepped side walls 54 with opposite ends 98L and 98R of each shelf 94A, 94B and 94C resting on the horizontal upper edges 82A, 82B and 82C of the wall's associated stair steps 78A, 78B and 78C. Cleats 100 are provided on the bottom 102 of each shelf 94A, 94B and 94C to prevent the shelves 94A, 94B and 94C from slipping off the stair stepped side walls 54.

Shelf spacers 104 are provided attached to the first stair step 78A immediately behind the display shelf 94A associated with the first cascading tank 40 to space the shelf 94A away from the front wall 14 of the tall water column 12 thereby allowing the water that is flowing from the tall water column 12 to pass between the front wall 14 of the tall water column 12 and the shelf 94A and enter into the first cascading tank 40.

Light fixtures 106 can optionally be provided underneath or inside the bottom reservoir 44 for up lighting the water panel 10 and its associated shelves 94A, 94B and 94C, as shown in FIGS. 2 and 3. If light fixtures 106 are located inside the bottom reservoir 44, the light cord 108 associated with each light fixture 106 may be run out of the water panel 10 with the electrical cord 50 for the water pump 48. Although not illustrated, lighting fixtures can alternately or additionally be placed underneath, above, behind, or in front of the water panel 10 to achieve the desired lighting effects.

Also, the water can be tinted with food coloring agents to make the water the desired color to match the mood, holiday, occasion, etc. Pacific blue is the standard color choice for the water. Further ornamentation can be provided by placing various objects in the cascading tanks 40 and 42 or in the bottom reservoir 44. Such objects might include either live or imitation fish, real or plastic ice cubes, real or imitation fruit slices, or other suitable ornaments.

If desired, a remote control (not illustrated) or timer can optionally be provided for remotely activating the water pump 48 and lighting fixtures 106. Remote control or timer activation of the water pump 48 and lighting fixtures 106 can be employed to produce striking visual impact.

Optionally, the water panel 10 can be equipped with a bubble generator (not illustrated) that supplies bubbles to the water contained in one or more of the following parts of the water panel 10: the tall water column 12, cascading water tanks 40 and 42, and bottom reservoir 44. Bubbles will create an interesting effect in the water contained in these parts of the water panel 10, with or without the continuing flow of water through these parts.

Figure 6:
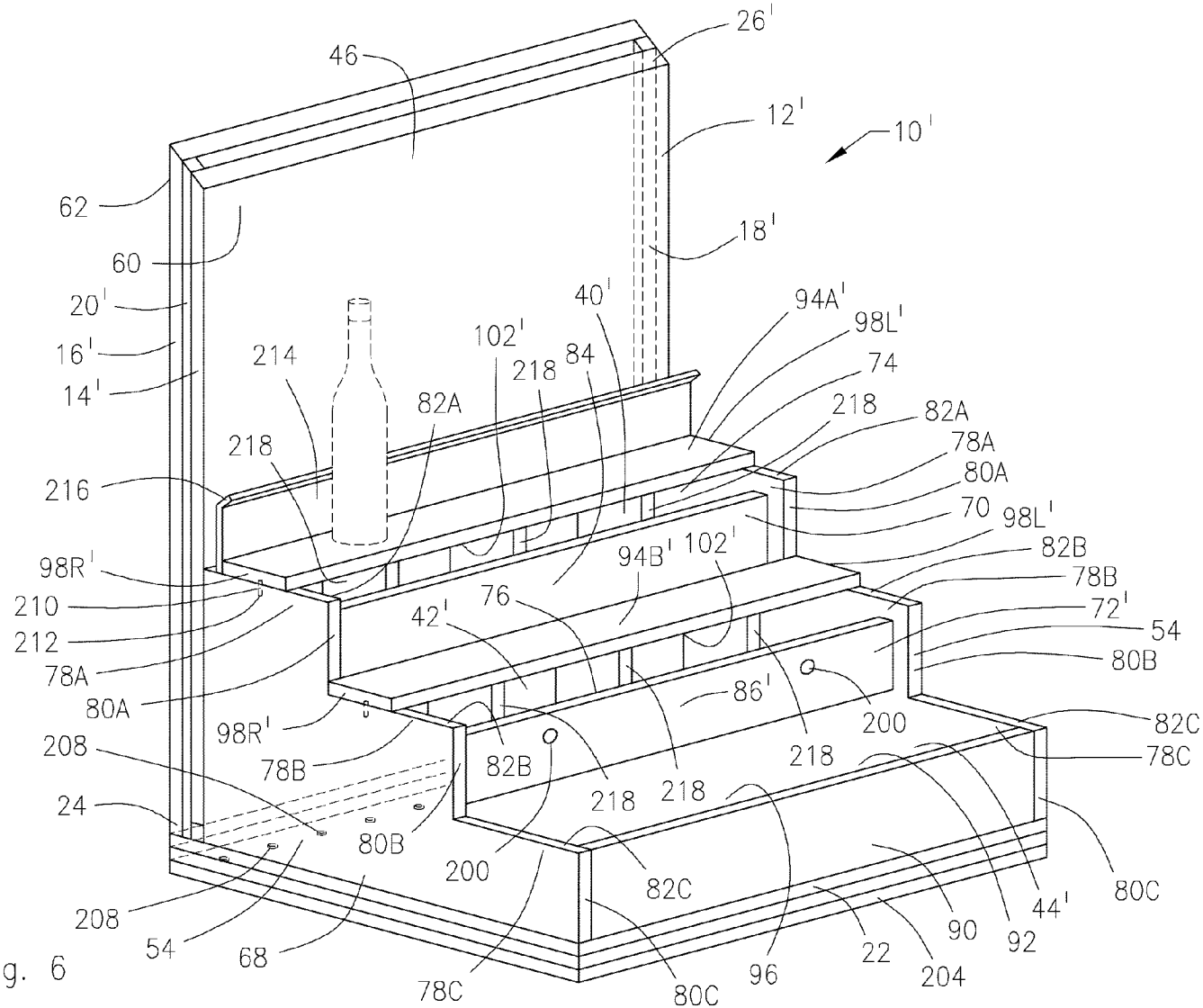
FIG. 6 is a perspective view of an alternate embodiment water column of the present invention shown resting on an optional light tray.
Figure 8:
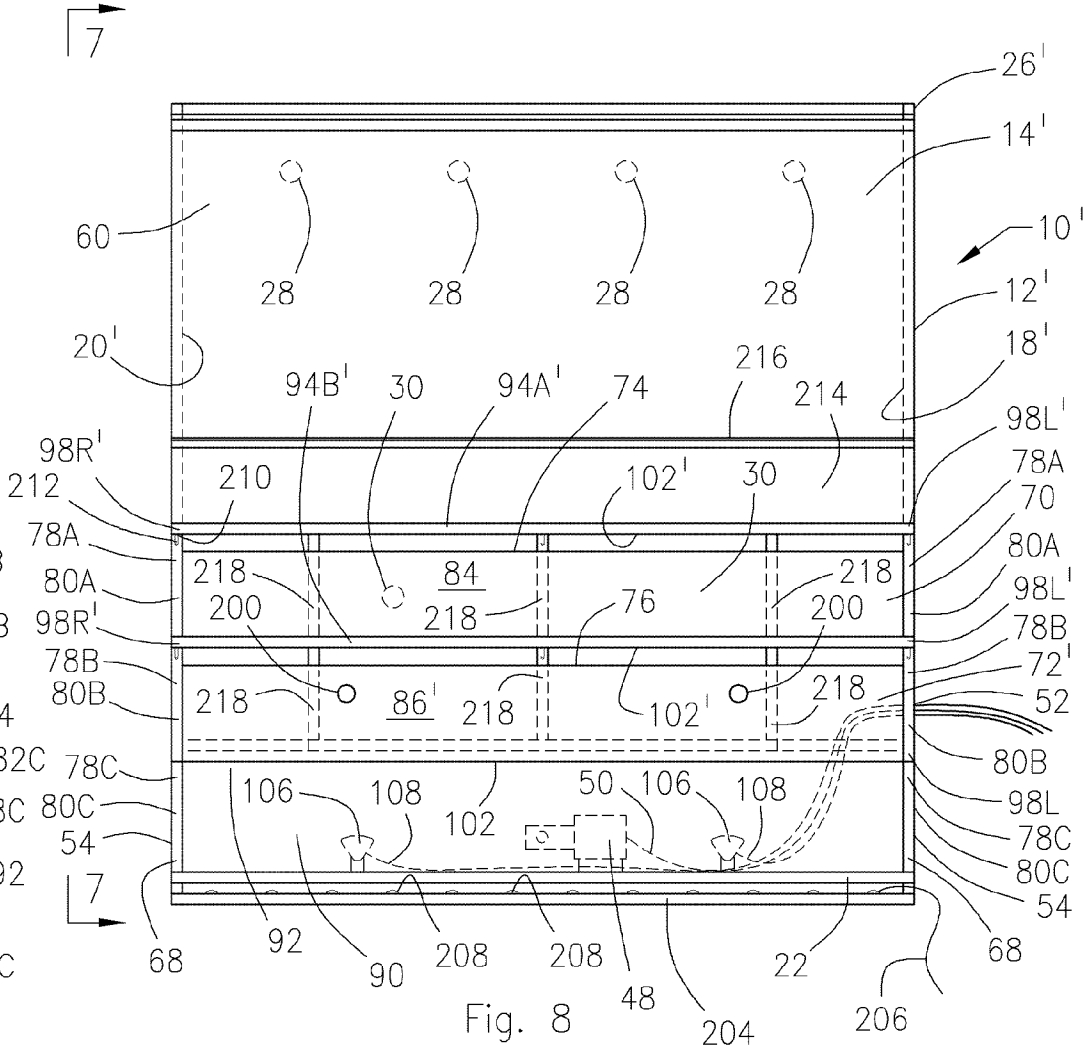
FIG. 8 is a front view of the alternate embodiment water column of FIG. 6.
Figure 7:
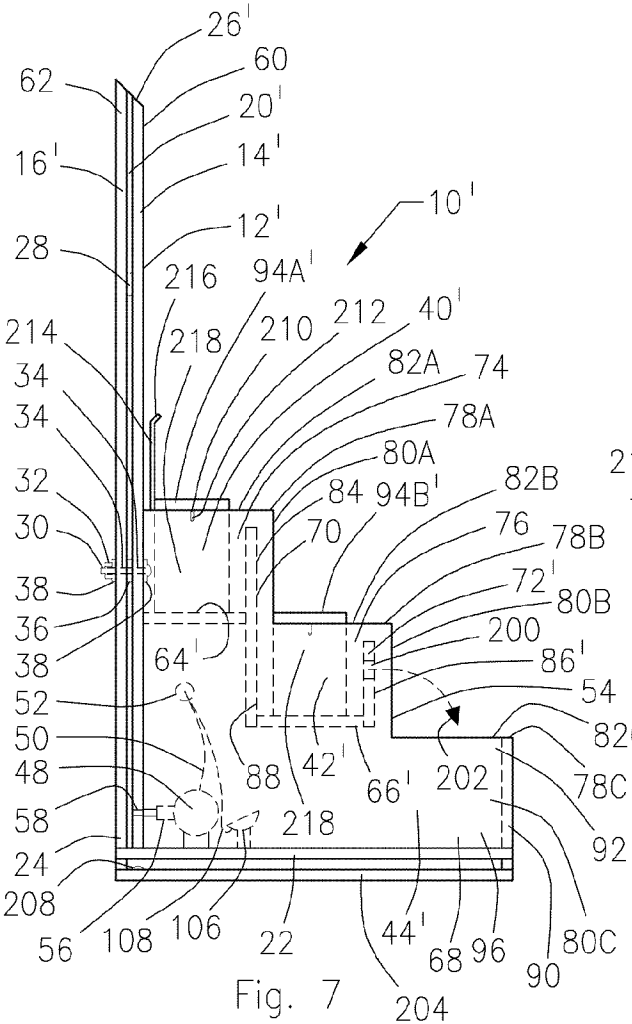
FIG. 7 is side view taken along line 7-7 of FIG. 8.

Referring now to FIGS. 6-8, there is illustrated an alternate embodiment 10' of the present invention that is modified to serve as a self-serve drinking fountain. This alternate embodiment 10' removes the lowest removable display shelf 94C and adds fountain openings 200 in the outside face 86' of the front wall 72' of the second cascading tank 42' so that liquid, such as alcoholic beverages, contained within the alternate embodiment water panel 10' can flow through each of the fountain openings 200 in a separate stream, as indicated by Arrow 202 in FIG. 7. The beverage can be captured in a drinking glass (not illustrated) by placing the drinking glass under one of the flowing streams 202. When drinking glasses are not located under the flowing streams 202, the streams 202 of beverage fall into the bottom reservoir 44' and the beverage is recycled through the alternate water panel 10'. This alternate embodiment 10' may also include several other modifications which will be described in more detail hereafter.

One modification is to include an approximately 45 degree bevel on the top ends 26' of the tall water column 12' so as to better receive and reflect light. These beveled top ends 26' are preferably provided on the front, rear, and both side panels 14', 16', 18' and 20' of the tall water column 12'.

Still another modification is the addition of a light tray 204 under the alternate water column 10' so that light is directed up into the alternate water column 10' and is made visible by the 45 degree beveled top ends 26' of the tall water column 12'. The light tray 204 is a separate accessory and preferable is placed under the water column 10' as a base upon which the water column 10' rests. The light tray 204 is provided with an electrical power supply cord 206 for attachment to an electrical power supply (not illustrated) and is preferably provided with a plurality of LED lights 208 that are oriented so that their light is projected upward. The light tray 204 is a separate unit from the water column 10' and is not in contact with the liquid contained in the water column 10'. The light tray 204 adds to the visual effect of the water column 10', particularly when they are used together in a setting where the ambient light is low. The light tray 204 may be constructed of clear materials so that light from the LED lights 208 is free to travel upward through the light tray 204 and through the water column 10'.

Another modification is the addition of downwardly extending pegs 210 provided on the bottom 102' of each shelf 94A' and 94B' at the ends 98L' and 98R' of the shelves 94A' and 94B'. These pegs 210 are received into peg holes 212 provided in the stair stepped side walls 18' and 20' to positively retain the shelves 94A' and 94B' on the side walls 18' and 20' and thereby prevent the shelves 94A' and 94B' from slipping off of the stair stepped side walls 18' and 20'. The pegs 210 and peg holes 212 are located so that the highest shelf 94A' is spaced away from the front wall 14' of the tall water column 12' so water can pass behind the highest shelf 94A' without coming into contact with the shelf 94A'. Also the pegs 210 and peg holes 212 are located so that the second shelf 94B' is located away from the outside face 86' of the front wall 72' of the cascading tank 42' that is located behind or upstream in the flow path from the shelf 94B'. This allows water that flows down the front wall 72' of the second cascading tank or water chamber 42' to pass behind the second shelf 94B' without contacting the shelf 94B' that is located in front of the water chamber 42'. The addition of these pegs 210 to the shelves 94A' and 94B' makes it unnecessary to include shelf spacers 104 and cleats 100 on the shelves 94A' and 94B'.

Still another modification is the addition of an upwardly extending splash guard back wall 214 that is attached to the back of the upper shelf 94A'. This splash guard back wall 214 is preferably provided with a forward extending wire bend top lip 216 that extends forward at approximately a 45 degree angle from the vertical back wall 214. The purpose of the splash guard back wall 214 and the wire bend top lip 216 is to prevent liquid that is falling down the front wall 14' of the tall water column 12' from being splashed up onto the back shelf 94A'. Thus, this alternate embodiment 10' is designed to maintain the shelves 94A' and 94B' in a dry condition. Keeping these shelves 94A' and 94B' dry is important, particularly when the shelves 94A' and 94B' of the water panel 10' are being employed to display items that might be adversely affected by contact with moisture or which might slip on the wet shelves.

Finally, the shelves 94A' and 94B' of the alternate embodiment 10' may be provided with legs 218 that attach to the bottoms 102' of the shelves 94A' and 94B' and extend downward to rest on the bottoms 64' and 66' of the cascading tanks 40' and 42' that are located under the shelves 94A' and 94B'. The addition of these legs 218 provides additional support to the shelves 94A' and 94B' to prevent them from bowing or breaking which is particularly important if the shelves 94A' and 94B' are long or the items that are to be displayed on the shelves 94A' and 94B' are heavy.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A frameless portable customizable water panel for displaying advertising and products that can also function as a self-serve drinking fountain comprising:

a water column constructed of transparent material closed on all sides except at an open top, said water column having a front wall and a back wall, said front wall and said back wall held in approximately parallel, spaced-apart orientation by means of transparent strips approximately one-eighth the thickness of each wall that are glued between the sides and bottom of the front and back walls, by transparent discs glued to the inside faces of the front and back walls, and by rust-proof bolts with nuts that secure through strategically-placed bolt openings provided in the front and rear walls, said strips, discs, and thru-bolts with nuts located so as to maintain a space between the front and rear walls to contain the water and to prevent the front and rear walls from being pushed apart by the force of water contained between the walls, the front wall being shorter than the rear wall so that water pumped into the water column will overflow down the outside face of the front wall, cascading water tanks provided adjacent to the front wall for receiving water that flows down the outside face of the front wall, a bottom tank that serves as reservoir for the water that flows down through all the cascading water tanks above it, a water pump associated with said bottom reservoir, said water pump receiving water from the bottom reservoir and discharging water into a bottom of the front wall of the water column as a means of recirculating water to the water column, said water column and its spacer strips, said cascading water tanks and said bottom reservoir all being constructed of transparent material, such that the frameless water column appears to the eye to be but a single wall, removable shelves supported above each said cascading water tank by side walls of the cascading water tanks, each of said removable shelves held in spaced apart relationship from the front wall of the tank located immediately behind it so that water flows behind and under each removable shelf and does not contact any shelf so that the removable shelves remain dry, a front wall of the bottom cascading tank provided with at least one fountain opening extending through the front wall so that water contained within the bottom cascading tank flows through each fountain opening in a separate stream that falls into the bottom reservoir, and top edges of the tall water column provided with bevel of approximately 45 degrees so as to better receive and reflect upwardly projected light.

2. A frameless portable customizable water panel for displaying advertising and products that can also function as a self-serve drinking fountain comprising:

a water column constructed of transparent material closed on all sides except at an open top, said water column having a front wall and a back wall, said front wall and said back wall held in approximately parallel, spaced-apart orientation by means of transparent strips approximately one-eighth the thickness of each wall that are glued between the sides and bottom of the front and back walls, by transparent discs glued to the inside faces of the front and back walls, and by rust-proof bolts with nuts that secure through strategically-placed bolt openings provided in the front and rear walls, said strips, discs, and thru-bolts with nuts located so as to maintain a space between the front and rear walls to contain the water and to prevent the front and rear walls from being pushed apart by the force of water contained between the walls, the front wall being shorter than the rear wall so that water pumped into the water column will overflow down the outside face of the front wall, cascading water tanks provided adjacent to the front wall for receiving water that flows down the outside face of the front wall, a bottom tank that serves as reservoir for the water that flows down through all the cascading water tanks above it, a water pump associated with said bottom reservoir, said water pump receiving water from the bottom reservoir and discharging water into a bottom of the front wall of the water column as a means of recirculating water to the water column, said water column and its spacer strips, said cascading water tanks and said bottom reservoir all being constructed of transparent material, such that the frameless water column appears to the eye to be but a single wall, removable shelves supported above each said cascading water tank by side walls of the cascading water tanks, each of said removable shelves held in spaced apart relationship from the front wall of the tank located immediately behind it so that water flows behind and under each removable shelf and does not contact any shelf so that the removable shelves remain dry, a front wall of the bottom cascading tank provided with at least one fountain opening extending through the front wall so that water contained within the bottom cascading tank flows through each fountain opening in a separate stream that falls into the bottom reservoir, and an upwardly extending splash guard back wall attached to the back of the upper shelf.

3. A frameless portable customizable water panel for displaying advertising and products that can also function as a self-serve drinking fountain according to claim 2 further comprising:

said splash guard back wall provided with a forward extending wire bend top lip that extends forward at approximately a 45 degree angle.

4. A frameless portable customizable water panel for displaying advertising and products that can also function as a self-serve drinking fountain comprising:

a water column consisting of transparent material closed on all sides except at an open top, said water column having a front wall and a back wall, said front wall and said back wall held in approximately parallel, spaced-apart orientation by means of transparent strips approximately one-eighth the thickness of each wall that are glued between the sides and bottom of the front and back walls, transparent discs glued to the inside faces of the front and back walls, and by rust-proof bolts with nuts that secure through strategically and by rust-proof bolts with nuts that secure through strategically-placed bolt openings provided in the front and rear walls, the strips, discs, and thru-bolts with nuts maintain a space between the front and rear walls to contain the water and to prevent the front and rear walls from being pushed apart by the force of water contained between such walls, the front wall being shorter than the rear wall so that water pumped into the water column will overflow down the outside face of the front wall, cascading water tanks provided adjacent to the front wall for receiving water that flows down the outside face of the front wall, including a bottom tank that serves as reservoir for the water that flows down through all the cascading water tanks above it, a water pump associated with said bottom reservoir, said water pump receiving water from the bottom reservoir and discharging water into a bottom of the front wall of the water column as a means of recirculating water to the water column, said water column and its spacer strips, said cascading water tanks and said bottom reservoir all being constructed of transparent material, such that the frameless water column appears to the eye to be but a single wall, removable shelves supported above each said cascading water tank by side walls of the cascading water tanks, each of said removable shelves held in spaced apart relationship from the front wall of the tank or reservoir located immediately behind it so that water flows behind and under each removable shelf and does not contact any shelf so that the removable shelves remain dry, a front wall of the bottom cascading tank provided with at least one fountain opening that extends through the front wall so that water contained within the bottom cascading tank flows through each fountain opening in a separate stream that falls into the bottom reservoir, downwardly extending pegs provided on the bottom of each shelf at the ends of the shelves; said stair stepped side walls provided with peg openings for removably receiving the pegs therein as a means of retaining the shelves in the proper location on the side walls, said pegs and peg holes are located so that the highest shelf is spaced away from the front wall of the tall water column so water can pass behind the highest shelf and so that the other shelves are located away from the outside face of the front wall of the cascading tank located behind the shelf so that water can pass behind the other shelves, an upwardly extending splash guard back wall attached to the back of the upper shelf, and said splash guard back wall provided with a forward extending wire bend top lip that extends forward at an angle of approximately a 45 degrees.

5. A frameless portable customizable water panel for displaying advertising and products that can also function as a self-serve drinking fountain according to claim 4 further comprising:

top edges of the tall water column provided with approximately a 45 degree bevel so as to better receive and reflect light, and an LED light fixture provided in association with the water column, the cascading water tanks and removable shelves for projecting light upward into the water column, the cascading water tanks and removable shelves.

6. A frameless portable customizable water panel for displaying advertising and products that can also function as a self-serve drinking fountain according to claim 5 further comprising:

remote activation means for remotely controlling operation of the pump and light fixture.

7. A frameless portable customizable water panel for displaying advertising and products that can also function as a self-serve drinking fountain according to claim 5 further comprising:

a timer device for controlling operation of the water pump and the light fixture.

8. A frameless portable customizable water panel for displaying advertising and products that can also function as a self-serve drinking fountain according to claim 5 further comprising:

at least one leg attached to the bottom of each shelf, each leg extending downward from the bottom of the shelf and resting on a bottom of the cascading tank located under the shelf to prevent the shelf from bowing or breaking when heavy items are placed on the shelf.

9. A frameless portable customizable water panel for displaying advertising and products that can also function as a self-serve drinking fountain according to claim 8 further comprising:

advertising attached to at least one wall of the column so that the advertising is visible through the water column and water.

* * * * *